US006481046B1

(12) United States Patent
Freund et al.

(10) Patent No.: US 6,481,046 B1
(45) Date of Patent: Nov. 19, 2002

(54) METHOD AND APPARATUS FOR CLEANING FROM THE OUTER SURFACE OF AN ENDLESS TRANSPORT BELT THE INK, NOT EJECTED FOR PRINTING PURPOSES, OF AN INKJET PRINTER

(75) Inventors: Michael N. Freund, Adelberg (DE); Kurt Stehle, Neuffen (DE)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/535,323

(22) Filed: Mar. 27, 2000

(30) Foreign Application Priority Data

Mar. 31, 1999 (DE) ..... 199 14 563

(51) Int. Cl.[7] ..... A47L 5/00
(52) U.S. Cl. ..... 15/309.1; 15/345; 101/423
(58) Field of Search ..... 15/309.1, 345; 101/423

(56) References Cited

U.S. PATENT DOCUMENTS

| | | | | |
|---|---|---|---|---|
| 2,515,223 A | * | 7/1950 | Hollick | 139/1 C |
| 2,956,301 A | * | 10/1960 | Bruno | 15/309.1 |
| 4,454,621 A | * | 6/1984 | Testone | 15/1.51 |
| 4,861,178 A | | 8/1989 | Reed | |
| 5,072,671 A | | 12/1991 | Schneider et al. | |
| 5,220,868 A | | 6/1993 | Dunnam | |
| 5,225,853 A | | 7/1993 | Kobayashi et al. | |
| 5,603,775 A | | 2/1997 | Sjoberg | |
| 5,732,631 A | | 3/1998 | Walther et al. | |
| 2001/0028372 A1 | * | 10/2001 | Yoshimura | 347/30 |

FOREIGN PATENT DOCUMENTS

| | | |
|---|---|---|
| DE | 39 37 860 C2 | 1/1997 |
| EP | 0 269 602 B1 | 1/1992 |
| EP | 0 744 301 A1 | 11/1996 |
| GB | 1 560 641 | 2/1980 |
| JP | 06 055731 | 3/1994 |

* cited by examiner

*Primary Examiner*—Chris K. Moore
(74) *Attorney, Agent, or Firm*—Milton S. Sales

(57) ABSTRACT

The invention relates to a method and an apparatus for cleaning from the outer surface of an endless transport belt the ink, not ejected for printing purposes, of an inkjet printer, said method and apparatus serving for completely removing and collecting the ink adhering to the transport belt, while retaining a high transport belt speed. The method is characterized by the application of a converging compressed-air stream onto the outer surface of the ink-wetted transport belt by means of an air conduit, comprising a suction nozzle, of a pressure nozzle, and by extraction of the resulting ink-air mixture by means of the suction nozzle, the two steps being performed simultaneously. The apparatus which is arranged downstream of an inkjet printing device in the transport path of the transport belt is characterized by a pressure nozzle for applying compressed air onto the outer surface of the ink-wetted transport belt, said pressure nozzle being formed by a suction nozzle arranged centrally in the pressure nozzle to extract the ink-air mixture produced by the compressed air.

4 Claims, 3 Drawing Sheets

METHOD AND APPARATUS FOR CLEANING FROM THE OUTER SURFACE OF AN ENDLESS TRANSPORT BELT THE INK, NOT EJECTED FOR PRINTING PURPOSES, OF AN INKJET PRINTER

FIELD OF THE INVENTION

The invention relates to a method and an apparatus for cleaning from the outer surface of an endless transport belt the ink, not ejected for printing purposes, of an inkjet printer.

BACKGROUND OF THE INVENTION

A cleaning apparatus is known from European patent application 0 744 301 A1 for an endless transport belt in an inkjet printer, in which the presence of ink on the transport belt is detected by sensors arranged on both sides of the belt immediately following the inkjet print head. Before cleaning, the printing material printed on the transport belt is passed through a microwave drying station to dry the ink on the printing material. The drying station is followed by two ink-absorbing cleaning belts arranged on both sides of the transport belt and brought into contact with the transport belt in accordance with a signal triggered by the sensors. For cleaning the transport belt, the cleaning belts are wetted on their rear faces with an ink cleaning fluid and moved against the transport direction of the transport belt.

European patent 0 269 602 B1 issued Jan. 2, 1992, describes a method for drying of printed materials web in which the latter are fixed in non-slip form on a transport belt, passed with the transport belt in a straight line through the dryer and then lifted off the transport belt. Thus, a material web screen-printed using printing ink can be lifted off the transport belt without smudging. The belt is then subjected to wet cleaning by means of a belt washing apparatus, said apparatus being followed by a water-squeezing device for removing the water quantity carried by the transport belt. For complete drying of the transport belt, the latter is passed through a dryer so that the belt can subsequently receive the material web again.

The disadvantage of the apparatuses described is that cleaning fluids are used for removing residual dye or ink on the transport belt and have to be removed again from the band by correspondingly expensive equipment. In addition, the transport belt must then be subjected to drying before a new printing material can be placed on it or supplied to it.

A particular drawback of European patent application 0 744 301 A1 is that the ink-wetted transport belt is first passed through the microwave dryer, which makes cleaning more difficult. This cleaning method also has the effect—due to the necessary friction between the cleaning belts and the transport belt—of increasing wear. In particular, high speeds of the transport belt cannot be achieved for printing of the printing materials, since otherwise cleaning the dried-on ink off the belt would not be assured.

The object underlying the present invention is to provide a method and apparatus for cleaning an endless transport belt from the excess ink output from an inkjet printer, with ink adhering to the transport belt being completely removable and collected while retaining a high transport belt speed.

SUMMARY OF THE INVENTION

In accordance with the invention, in a method for cleaning an endless transport belt from excess ink ejected by an inkjet printer, where upstream the outer surface is guided horizontally for printing a printing material by means of an inkjet print head, and downstream after printing and removal of the printing material the transport belt is deflected over a roller and conveyed to a cleaning apparatus, cleaning is performed by application of a converging compressed-air stream onto the outer surface of the ink-wetted transport belt by means of an air conduit, said conduit comprising a suction nozzle, and by extraction of the ink/air mixture produced using the suction nozzle, the application and extraction of the air stream being simultaneous. The convergence of the compressed air stream is produced by an outlet opening of the air conduit of the pressure nozzle, said opening being inclined peripherally relative to the suction nozzle. In particular it is achieved advantageously that in view of a high air stream directed to the suction nozzle on all sides, ink can only be separated and removed from the transport belt by air, with the drying of the transport belt being effected simultaneously and supported by the specially coated surface of the transport belt. As a result of the selected pressure parameters of the nozzles, where the magnitude of negative pressure exceeds that of the gauge pressure, spraying of the ink/air mixture into the surroundings of the transport belt is prevented, in particular by the fact that the compressed-air stream is applied at right angles to the transport direction of the transport belt over the entire transport belt width of the outer surface. Sensors used for detecting ink residues on the transport belt are also no longer necessary.

In the apparatus for cleaning the outer surface of an endless transport belt from ink ejected from an inkjet printer not for printing purposes, said apparatus being arranged in the transport path of the transport belt of an inkjet printer, a pressure nozzle is used for application of compressed air to the outer surface of the ink-wetted transport belt, said pressure nozzle being formed by a suction nozzle arranged centrally in the pressure nozzle for extraction of the ink/air mixture produced by the compressed air.

BRIEF DESCRIPTION OF THE DRAWINGS

Further features and advantages can be taken from the sub-claims in connection with the description of the design example explained in the figures.

In the diagrammatic drawings.

DETAILED DESCRIPTION OF THE INVENTION

Figure 1:
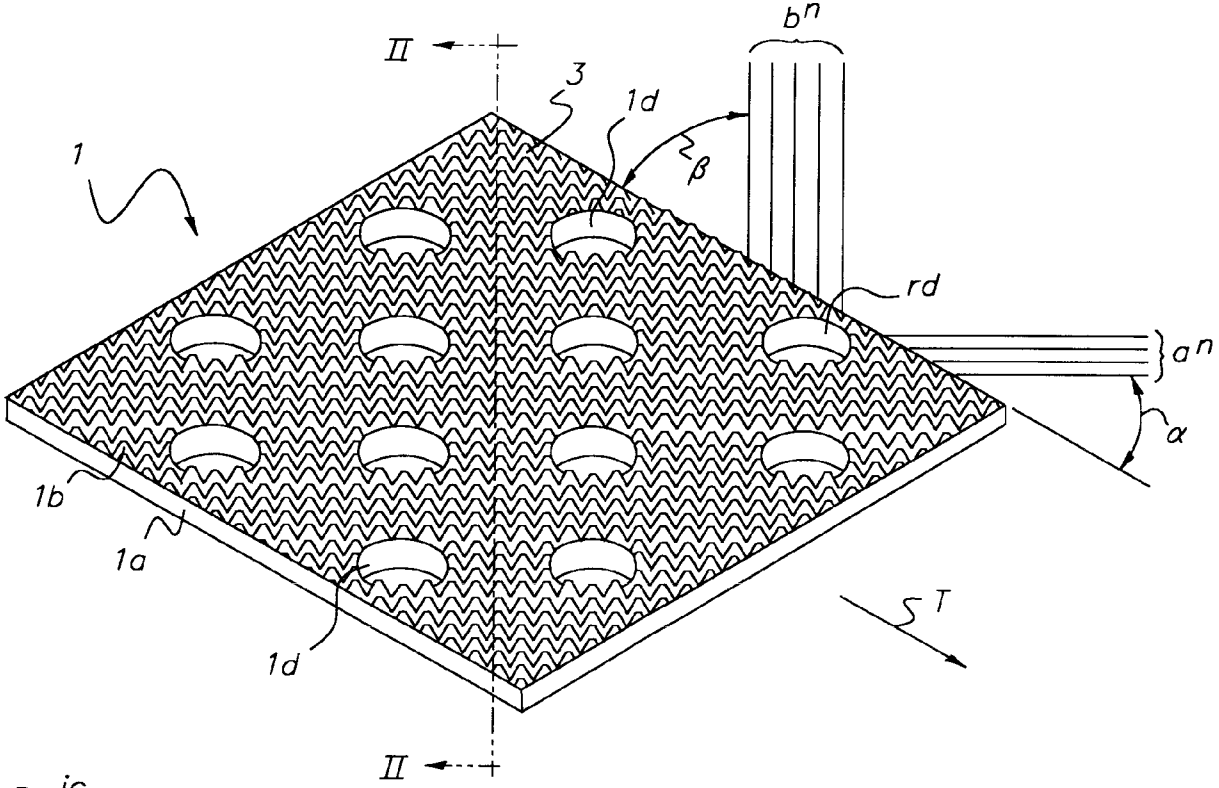
FIG. 1 shows a view of a belt section of a transport belt used.
Figure 2:
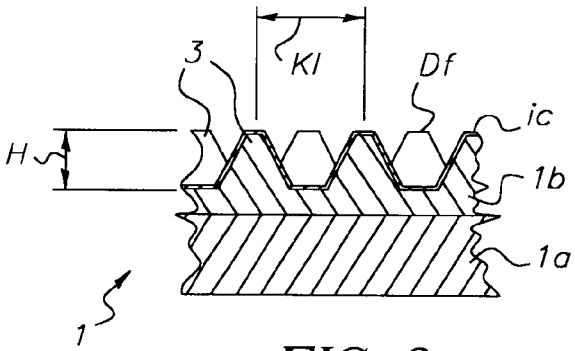
FIG. 2 shows a detailed view in a section along the line II—II in FIG. 1.
Figure 4:
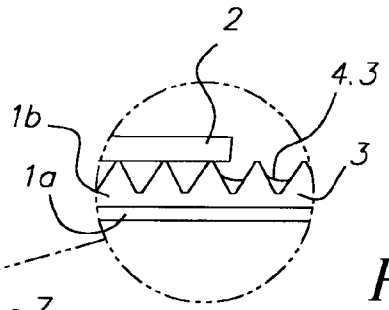
FIG. 4 shows a detailed view in accordance with the identification in FIG. 3.
Figure 3:
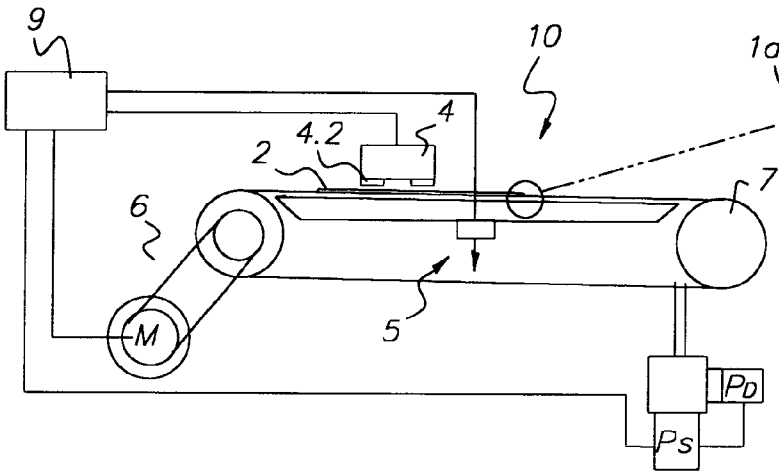
FIG. 3 shows a simplified view of an inkjet printer with transport belt and cleaning apparatus.

As shown in FIG. 3, an endless transport belt 1 is driven via the deflecting roller 7 by the drive unit 6 comprising the motor M, the toothed belt and the drive roller, and the printing material 2 supplied to the transport belt, for example inkjet paper with gloss effect for creating photographic prints, is printed by means of an inkjet printer 4. The inkjet printer 4 comprises a print head 4.1 configured as a full-line model for generating a line-by-line color print with a maximum width of 25.4 cm (10 inches.), a sensor 4.2 not described in detail here for detecting the position of printing material 2 supplied to the print head, and ink supply containers, not shown, for producing the color print. The ink 4.3 not ejected for printing purposes is deposited on the transport belt shown in FIGS. 1 and 2.

The transport belt 1 is formed by a carrier layer 1*a*, a support layer 1*b* and a hydrophobic and ink-rejecting layer 1*c*. The carrier layer 1*a* preferably comprises a polyester fabric, for example a belt with the designation SPH-11 from the company Habasit, in Rödermark, Germany. On this is arranged the support layer 1*b* with a knobbed 3 grid structure, comprising polyurethane-elastomer (TPE-U) or one of the groups TE (PESTUR, PEESTUR, PEUR) as per ISO/VDA designation. The knobbed grid forms grid lines $a^n$, $b^n$ (n=number of lines, 1.n) equally spaced, forming an angle $\alpha$, $\beta$ of 45° relative to the transport direction T of belt 1, so that the printing material 2 placed on the transport belt 1 and aligned parallel with the transport direction is not congruent with one of the grid lines at its leading, trailing or lateral edges. This ensures an optimum contact surface for the printing material 2 on the transport belt. The knob grid has along the grid lines $a^n$, $b^n$ an edge length (KL) of approximately 0.7 mm in each case, with the knobs preferably being configured as truncated cones or truncated pyramids.

The hydrophobic and ink-rejecting layer 1*c* is formed by a silicone layer that can be provided as a film or as a sprayed-on coating. The coating thicknesses here are approximately 0.03 to 0.08 mm, or 0.05 mm for the film. The application of the film to the support layer 1*b* is achieved by sufficiently known methods, for example by using an adhesion-promoting primer or by shrinking by applying heat.

For fixing the printing material 2 on the transport belt 1, the latter is provided with openings 1*d* through which a negative pressure can be produced by means of a suction box of a known vacuum device 5 arranged between the drive roller and the deflecting roller of the transport belt. The result is a suction effect on the printing material 2, so that between the printing material surface to be printed and an inkjet printer 4 a defined parallel gap or space is created. This also determines in the known manner the quality of the print.

As shown in FIG. 3, the excess ink 4.3 applied to the belt is removed by a transport belt cleaning apparatus 8 arranged downstream of the inkjet printer 4 and the deflecting roller 7. This cleaning apparatus comprises a rectangularly shaped suction nozzle 8.2 which forms an inner limitation for a likewise rectangularly shaped pressure nozzle 8.1 symmetrically surrounding the suction nozzle. Both nozzles are aligned at an angle of 90° to the transport direction T of the transport belt 1 in respect of the longitudinal centerlines $L_{1,2}$. The outer limitation of the pressure nozzle, which generally corresponds to the maximum width of the transport belt 1, has walls parallel and at a distance to the suction nozzle 8.2, said walls projecting approximately 3–4 mm beyond the suction nozzle and inclined at an angle of approximately 30 degrees all round towards the suction nozzle. The resultant air conduit for the compressed air produces an air stream converging on the transport belt with a predetermined pressure value in excess of 15 bar.

The air conduit of the suction nozzle ends in a suction box 8.32 that is connected via a suction line 8.5 and intake filter, non-return valve and ink separator (not shown) to a suction pump $P_S$. The value of the negative pressure is approximately 1 bar. The intake filter and non-return valve serve in the known manner to protect the suction pump. The air conduit of the pressure nozzle ends in a pressure box 8.6 which is connected via a pipe to a pressure pump $P_D$.

The drive of the transport belt 6, the inkjet printer 4 with print head 4.1 and sensor 4.2, the vacuum suction device 5 and the pressure and suction pumps $P_D$, $P_S$ of the cleaning apparatus 8 is controlled by an electronic control unit 9, with the pumps $P_D$, $P_S$ being in the switched-on state when the inkjet printer is in operation. After switching off the inkjet printer, the cleaning apparatus is then switched off after a time-lag, so that after the last printing of printing material the transport belt is dependably cleaned of ink or drying of the ink onto the transport belt is prevented.

Figure 5:
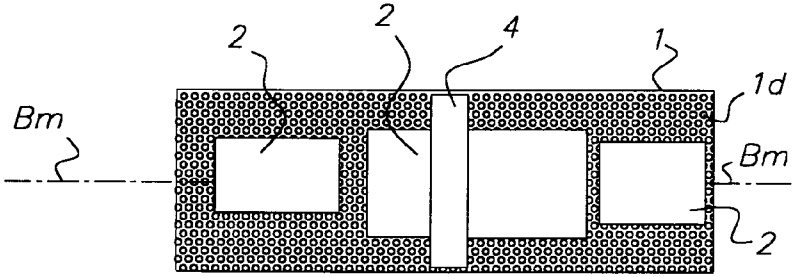
FIG. 5 shows a plan view onto the transport belt in accordance with FIG. 3.
Figure 6:
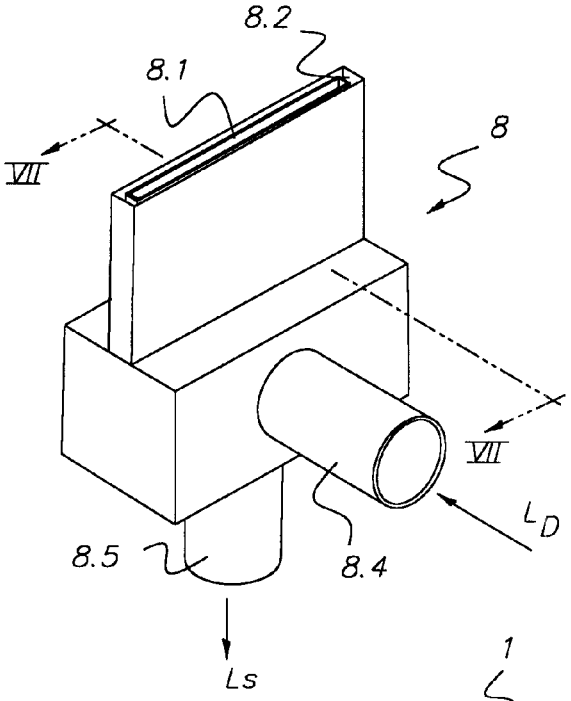
FIG. 6 shows a perspective view of the cleaning apparatus in accordance with the invention.

For printing individual printing materials 2 with differing widths and lengths, which can for example correspond to the photographic 35 mm or APS sizes, or of a printing material strip unwound from a supply reel and rewound after printing, these materials are, as shown in FIG. 5, placed onto the transport belt 1 by means of a feed device, not shown, centered on the belt center $B_m$ and parallel to the transport direction T. Different spaces can result between the various printing materials. The respective printing materials are gripped in the further course of transportation by the vacuum suction device 5 and fixed flat on the top surfaces Df of the knobs by the openings 1*d* provided in the transport belt. It is within the scope of the invention that instead of a vacuum device, other suitable holding means or methods can be used for the printing materials, for example by electrostatic charging of the transport belt, so that the latter can also be designed without openings 1*d*.

Figure 8:
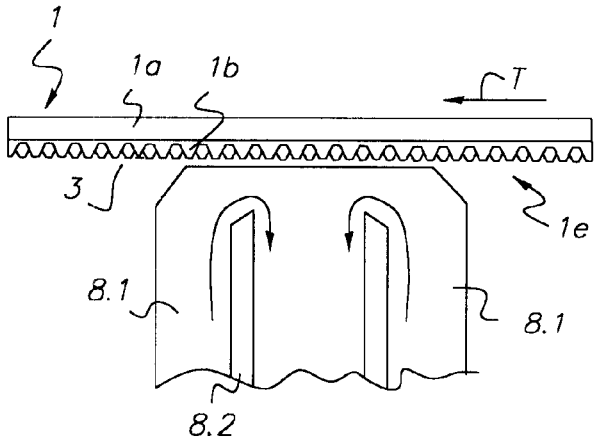
FIG. 8 shows an enlarged detailed view of the cleaning apparatus in accordance with the circuit marking in FIG. 7.
Figure 7:
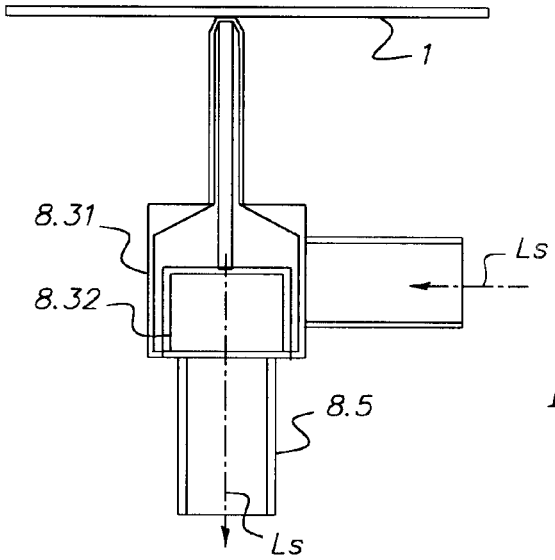
FIG. 7 shows a detailed view in a section along the line B—B in accordance with FIG. 6.

Since the inkjet print head 4 ejects ink in the full maximum possible line width (full-line print) and there is no interruption of the printing process between the individual printing materials, problems such as the blind ejection of ink as necessary in DE 39 37 860 C2 issued Jan. 16, 1997 for preventing the collection of air bubbles in the ink ducts of the print head are prevented. The excess ink 4.3 applied to the transport belt 1 as a result of the above operating mode of the inkjet printer 4 is reliably drawn off into the interstices of the knob grid structure by the design of the transport belt. Since the water of the ink used as solvent and the ink dyes are not absorbed by the transport belt, the ink can be removed from the transport belt 1 while wet by means of the cleaning apparatus 8. An ink/air mixture is produced by the pressure nozzle 8.1, as shown in FIG. 8, and is immediately drawn off by the increased pressure of the suction nozzle compared with the pressure nozzle and collected at the ink separator upstream of the pump.

The ink impacting the openings 1*d* in the transport belt during the printing process is substantially drawn off by the vacuum suction device 5, with any remaining ink still adhering being completely removed by the transport belt cleaning apparatus 8.

| PARTS LIST | |
|---|---|
| 10 | inkjet printer |
| 1 | transport belt |
| 1a | carrier layer |

-continued

| PARTS LIST | |
|---|---|
| 1b | support layer |
| 1c | coating, hydrophobic and ink-rejecting |
| 1d | openings |
| 1e | outer surface |
| 2 | printing material |
| 3 | knobbed grid structure |
| 4 | inkjet print head |
| 5 | vacuum suction device |
| 6 | belt drive |
| 6a | motor |
| 6b | drive roller |
| 7 | deflecting roller |
| 8 | transport belt cleaning apparatus |
| 8.1 | pressure nozzle |
| 8.2 | suction nozzle |
| 8.31 | pressure box |
| 8.32 | suction box |
| 8.4 | pressure line |
| 8.5 | suction line |
| 9 | electronic control unit |
| $\alpha$, $\beta$ | angle of grid lines to transport direction |
| $a^n$, $b^n$ | grid lines, n = number of lines |
| $B_m$ | transport belt center |
| Df | top surface |
| H | height |
| $K_L$ | edge length of knobbed grid structure |
| $L_{1,2}$ | longitudinal centerlines |
| $L_D$ | air intake/pressure side |
| $L_S$ | air outlet/suction side |
| M | motor |
| $P_D$ | pressure pump |
| $P_S$ | suction pump |
| T | transport direction |

What is claimed is:

1. An apparatus for cleaning ink from an outer surface of an endless transport belt of an inkjet printer, said apparatus being arranged along the transport belt downstream of an inkjet printing device, the apparatus comprising:

a pressure nozzle having inner and outer walls to define an air flow channel through which compressed air is applied onto the outer surface of the transport belt; and a suction nozzle (1) arranged centrally in the pressure nozzle to extract an ink-air mixture produced by the compressed air and (2) being formed by the inner walls of the suction nozzle the outer walls of the pressure nozzle are inclined peripherally inwardly toward the suction nozzle in order to reduce the cross section, the outer walls projecting toward the outer surface of the transport belt beyond the suction nozzle.

2. The apparatus according to claim 1, wherein the pressure nozzle and the suction nozzle have rectangular cross sections; and spacing between the pressure nozzle and the outer surface of the transport belt is 1 to 3 mm.

3. An apparatus according to claim 1, wherein the absolute negative pressure of the suction nozzle is greater than or equal to the absolute pressure of the pressure nozzle.

4. An apparatus according to claim 1, wherein:

the compressed-air is applied transverse to a transport direction of the transport belt across the entire outer surface of the transport belt; and the pressure nozzle and the suction nozzle have a common longitudinal axis oriented at right angles to the transport belt.

* * * * *